US005753113A

United States Patent [19]

Hendricks

[11] Patent Number: 5,753,113

[45] Date of Patent: May 19, 1998

[54] DEVICE TO AID SKIMMING SWIMMING POOLS

[76] Inventor: Roger G. Hendricks, 2184 Co. Rd. 19, Mingo Junction, Ohio 43938

[21] Appl. No.: 762,070

[22] Filed: Dec. 9, 1996

[51] Int. Cl.[6] ..... E04H 4/16

[52] U.S. Cl. ..... 210/169; 210/456

[58] Field of Search ..... 210/169, 242.1, 210/409, 456; 428/36.5, 36.9

[56] References Cited

U.S. PATENT DOCUMENTS

| | | | |
|---|---|---|---|
| 1,762,366 | 6/1930 | Test . | |
| 2,061,098 | 11/1936 | Nash . | |
| 2,579,304 | 12/1951 | Crawford . | |
| 3,152,076 | 10/1964 | Kreutzer . | |
| 3,244,284 | 4/1966 | Shaffer . | |
| 3,263,811 | 8/1966 | Baker et al. . | |
| 3,268,079 | 8/1966 | Sharrow, Jr. . | |
| 3,372,809 | 3/1968 | Spitzer . | |
| 3,625,364 | 12/1971 | La Chance . | |
| 3,774,767 | 11/1973 | Field . | |
| 3,811,478 | 5/1974 | Ahlqvist | 428/36.9 |
| 4,089,074 | 5/1978 | Sermons . | |
| 4,221,662 | 9/1980 | Joseph . | |
| 4,246,305 | 1/1981 | Delattre | 428/36.9 |
| 4,379,749 | 4/1983 | Roth . | |
| 4,455,695 | 6/1984 | Mikhel . | |
| 4,548,340 | 10/1985 | Messer . | |
| 4,707,253 | 11/1987 | Rowe . | |
| 4,720,340 | 1/1988 | O'Brien | 210/169 |
| 4,789,470 | 12/1988 | Wards . | |
| 4,879,028 | 11/1989 | Gibson . | |
| 4,954,375 | 9/1990 | Sattinger et al. | 428/36.9 |
| 4,968,545 | 11/1990 | Fellman et al. | 428/36.5 |
| 5,059,314 | 10/1991 | Beckman . | |
| 5,079,053 | 1/1992 | Chang | 428/36.9 |
| 5,173,181 | 12/1992 | McFarland . | |
| 5,264,122 | 11/1993 | Lakotish . | |
| 5,336,400 | 8/1994 | Patrice . | |
| 5,391,296 | 2/1995 | Rotundo et al. . | |
| 5,454,040 | 9/1995 | Lakotish . | |
| 5,490,923 | 2/1996 | Penney . | |
| 5,510,020 | 4/1996 | Gronlund . | |
| 5,510,021 | 4/1996 | Potthast . | |
| 5,525,217 | 6/1996 | Fulop | 210/169 |
| 5,536,397 | 7/1996 | D'Offay . | |
| 5,580,438 | 12/1996 | Silveri | 210/169 |

*Primary Examiner*—Stanley S. Silverman
*Assistant Examiner*—Theodore M. Green
*Attorney, Agent, or Firm*—Wood, Herron & Evans, L.L.P.

[57] ABSTRACT

A device that augments sidewall skimming of a swimming pool. The device is a substantially rectangular, hollow box with one end fitting within a sidewall skimmer and the other end protruding into the pool water. The device is made of a flexible, soft, foam-like material. The device is secured in the skimmer by inwardly deforming the end to be inserted and placing it in the skimmer where, upon release, its original shape is restored and a snug top and bottom friction fit is achieved. The sides of the device are in a loose fit within the skimmer. The device enhances sidewall skimming by channeling water along the sides of the device and into the skimmer, and by channeling water through its hollow internal cavity and into the skimmer.

6 Claims, 1 Drawing Sheet

DEVICE TO AID SKIMMING SWIMMING POOLS

FIELD OF THE INVENTION

This invention relates to a device that aids in skimming the water in a swimming pool.

BACKGROUND OF THE INVENTION

Skimmers are routinely used in swimming pools to filter debris and other objects from the surface of the water. They are necessary for health, safety, and aesthetic reasons and thus facilitate the use and enjoyment of swimming pools.

Both in-ground and above-ground pools have skimmers built into their sidewalls. Sidewall skimmers can normally only skim the water that is approximately two inches to three inches from the pool sidewall. Water more toward the center of the pool is not skimmed as often as water closer to the skimmer. In large pools, this may result in areas of water that have not been skimmed for an extended time.

Various devices are known in the prior art which can be mounted within a sidewall skimmer to direct pool debris and surface scum into the skimmer. These devices include, for example, arms (U.S. Pat. Nos. 4,789,470, 5,059,314, 5,510,020), booms (U.S. Pat. No. 4,879,028), units with convexly curved front walls (U.S. Pat. No. 5,490,923), and floating deflectors (U.S. Pat. No. 5,391,296). All the aforementioned devices, however, simply serve to channel the debris and scum into the skimmer, rather than to skim a larger surface area of the pool water.

Therefore, what is needed is a device that enhances normal skimming, by drawing water from near the pool sidewall and also water from more toward the center of the pool, and further diverting surface debris into the skimmer.

SUMMARY OF THE INVENTION

In accordance with the invention, there is provided a device which aids in skimming the water in in-ground or above-ground swimming pools. The device is preferably a flexible, hollow, rectangular box, one end of which (the proximal end) fits into a sidewall skimmer and the other end (the distal end) extends approximately six or more inches into the pool. The dimensions of the device can be varied, depending upon the dimensions of the opening in the sidewall skimmer. It is intended that the device be held securely in place in the skimmer by a friction fit between the top and bottom skimmer walls and the top and bottom walls of the device. It is further intended that the skimming aid of the present invention not completely fill the pool sidewall skimmer opening, and thus it should be narrower in the lateral dimension than the skimmer opening. The distal end of the device, which extends out into the pool, can be angled to facilitate water flow into the device. The proximal end may also be angled so the device is reversible. In one embodiment, the orientation of the angled distal end may be determined by the location of the sidewall skimmer within the pool. Both the angled distal end and the narrow lateral dimension are features of the invention which are advantageous in augmenting skimming, as will be discussed.

The device is preferably made of a relatively soft, flexible, foam-like material. Use of such material may reduce injury to swimmers, such as the blunt trauma that may occur when a swimmer advertently or inadvertently comes into contact with the device during normal use of the pool. Furthermore, the buoyancy of the device is enhanced by the use of such material and also by the device being hollow. In one embodiment, the device may be colored to match or contrast with the color of the pool. In another embodiment, the foam-like material may be treated to retard degradation by ultraviolet light. The flexibility of the device allows it to be deformed for easy insertion and removal from the skimmer. Once inserted, the normal rectangular shape of the device is immediately restored to allow a proper and secure fit within the skimmer.

The device is an improvement over prior art in that it augments sidewall skimming. While skimming at a pool sidewall still occurs with the device in place within the skimmer, the device of the present invention diverts water that is more toward the center of the pool into the skimmer. Thus, water toward the middle of the pool is more readily skimmed. The loose fit of the lateral sides of the device permit water to flow along the sides and into the sidewall skimmer. The angled distal end of the device channels water into its hollow interior cavity and directs water flow into the sidewall skimmer. In this way, the device acts as an extension of the skimmer.

Therefore, one aspect of the present invention is a device that aids in skimming a swimming pool. The device has a flexible, box-like shape that is readily deformable for easy insertion of one end into the sidewall skimmer of a pool. It is secured in the skimmer by a friction fit of its top and bottom surfaces. The device is hollow and may have an angled distal end to further aid in channeling water into the skimmer.

Another aspect of the present invention is a method of augmenting normal sidewall skimming of a swimming pool. The device facilitates water flow into the skimmer in two ways: (1) by providing an extended lateral surface that channels water along its sides and into the skimmer, and (2) by providing an angled distal end and a hollow interior cavity through which water flows into the skimmer. Thus, while water within two to three inches of the sidewall skimmer is skimmed as usual, a greater surface area of pool water is skimmed by use of the device of the present invention.

The above and other objects and advantages of the present invention will become apparent from the accompanying drawings and the detailed description thereof.

BRIEF DESCRIPTION OF THE DRAWINGS

The accompanying drawings, which are incorporated in and constitute a part of this specification, illustrate embodiments of the invention and, together with the general description of the invention given above, and the detailed description of the embodiments given below, serve to explain the principles of the invention.

DETAILED DESCRIPTION

The present invention relates to a device that augments pool sidewall skimmers.

Figure 1:
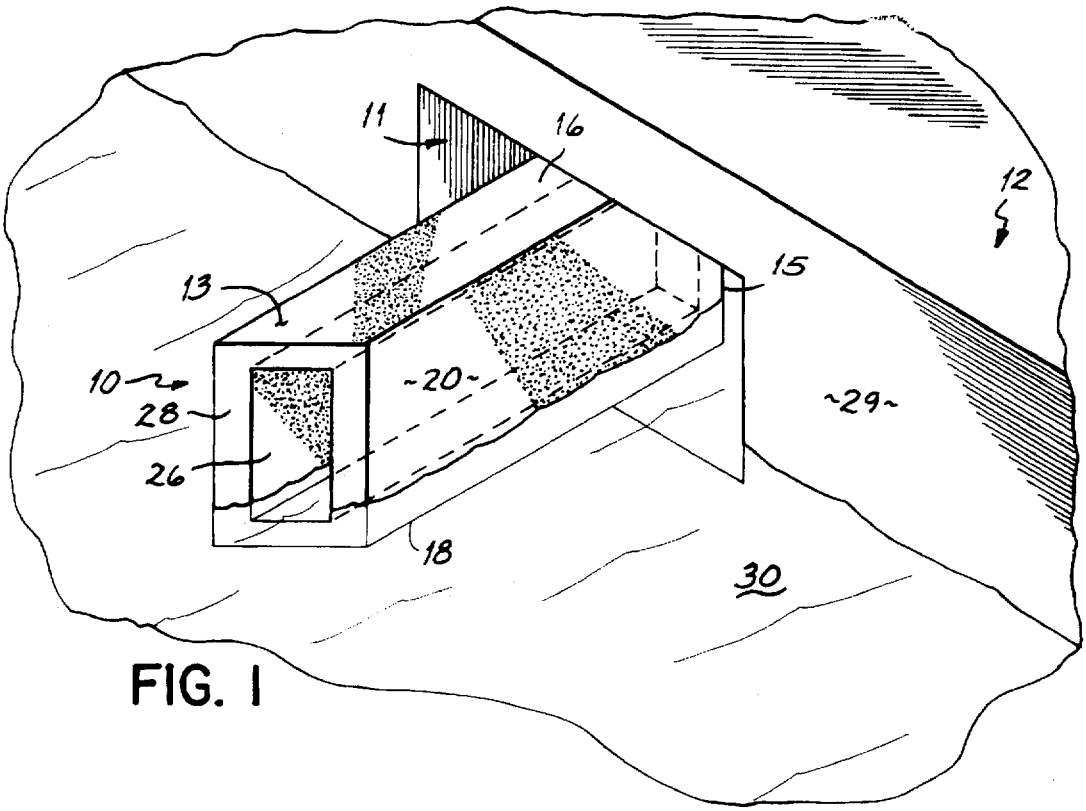
FIG. 1 is a perspective view of the device in place in a pool sidewall skimmer.

FIG. 1 shows the device 10 positioned within a sidewall skimmer 11 of an in-ground swimming pool 12. It will be appreciated that the device 10 is equally useful with sidewall skimmers in above-ground pools. The device 10 is preferably composed of a soft, flexible polymeric foam or foam-like material 13. The device 10 is inserted into the skimmer 11 by compressing its proximal end 15 until the end 15 easily fits within the skimmer 11, and then releasing the end 15 whereupon the original rectangular shape of the device 10 is generally restored. The device 10 fits within the sidewall skimmer 11 so that part of its top 16 and bottom 18 surfaces are secured in a friction fit within the skimmer 11, while the lateral surfaces 20 fit loosely within the skimmer 11, due to the narrower lateral dimension of the device 10. The device 10 is substantially rectangular in shape and defines a hollow interior cavity 26, through which pool water is drawn. The distal end 28 of the device 10 may be cut at an angle as shown. Although not shown, the proximal end 15 may also be cut at an angle, thereby rendering device 10 reversible. The device 10 is substantially straight and, in one embodiment, is approximately eighteen inches long by three inches wide by six inches high.

Figure 2:
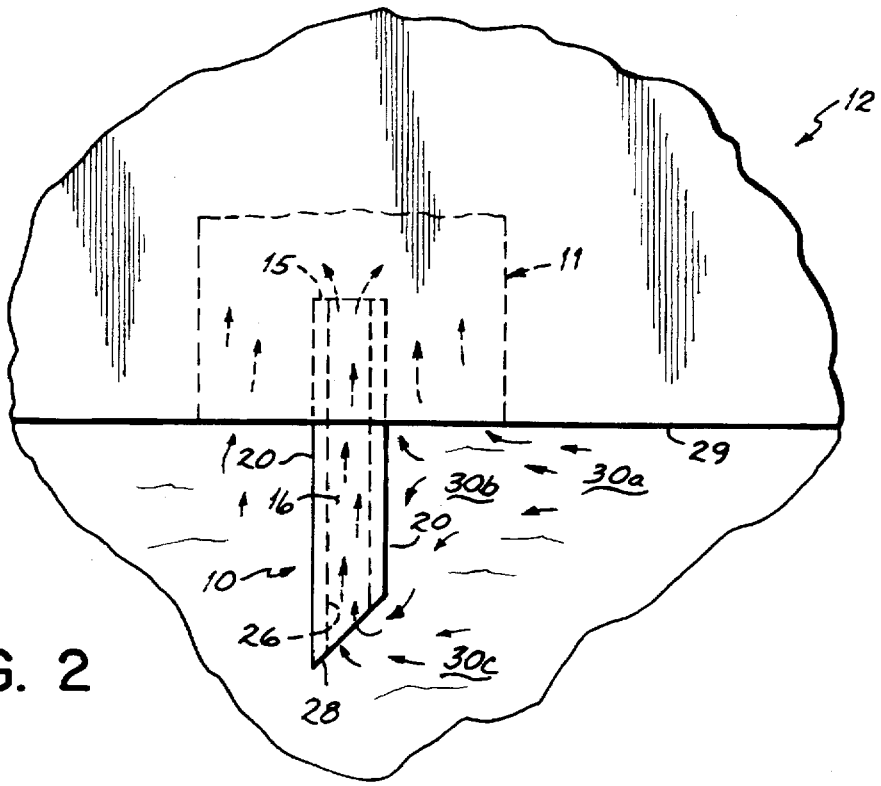
FIG. 2 is a top plan view of the device in operation in a pool.

FIG. 2 represents the device 10 in use in a swimming pool sidewall 29. Water 30*a* within two to three inches of the pool sidewall 29 is skimmed, as would occur without the device 10 in place. The device 10 augments normal sidewall swimming by channeling water 30*b* flow along its lateral surfaces 20, as well as channeling water 30*c* to flow through the hollow interior cavity 26 of the device 10. Surface debris and scum from water toward the middle of the pool is channeled into the sidewall skimmer 11 by the extended lateral surfaces 20 of the device 10. In this way, water 30*b*, 30*c* that is more than two to three inches from the sidewall skimmer 11 is skimmed.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A device to aid in skimming a swimming pool, comprising a box in combination with a swimming pool sidewall skimmer, said box defining a hollow cavity, said box having proximal and distal ends and being made of a flexible polymeric material, and configured to fit within said swimming pool sidewall skimmer in a secure top and bottom friction fit of said proximal end, said distal end extending into said pool.

2. The device of claim 1 wherein said box has a substantially rectangular shape.

3. The device of claim 1 wherein said flexible polymeric material is a foam.

4. The device of claim 1 wherein said distal end is cut at an angle of approximately forty-five degrees.

5. The device of claim 1 wherein said box is in the range of approximately eighteen inches long by three inches wide by six inches high.

6. The device of claim 1 wherein said flexible polymeric material is treated to resist damage by ultraviolet light.

* * * * *